US010016968B2

(12) United States Patent
Izume

(10) Patent No.: US 10,016,968 B2
(45) Date of Patent: Jul. 10, 2018

(54) DAMPENING APPARATUS FOR PRINTER AND PRINTER HAVING THE SAME

(71) Applicant: I. MER CO., LTD., Kyoto-shi (JP)

(72) Inventor: Masayuki Izume, Kyoto (JP)

(73) Assignee: I. MER CO., LTD., Kyoto-Shi (JP)

( * ) Notice: Subject to any disclaimer, the term of this patent is extended or adjusted under 35 U.S.C. 154(b) by 0 days.

(21) Appl. No.: 15/122,181

(22) PCT Filed: May 13, 2016

(86) PCT No.: PCT/JP2016/064312

§ 371 (c)(1),
(2) Date: Aug. 29, 2016

(87) PCT Pub. No.: WO2016/194583

PCT Pub. Date: Dec. 8, 2016

(65) Prior Publication Data

US 2017/0151771 A1 Jun. 1, 2017

(30) Foreign Application Priority Data

Jun. 3, 2015 (JP) ..... 2015-112932
Nov. 19, 2015 (JP) ..... 2015-226386

(51) Int. Cl.
*B41F 33/10* (2006.01)
*B41F 7/26* (2006.01)
*B41F 31/13* (2006.01)

(52) U.S. Cl.
CPC ..... *B41F 7/26* (2013.01); *B41F 31/13* (2013.01); *B41F 33/10* (2013.01)

(58) Field of Classification Search
CPC ..... B41F 31/045; B41F 7/26; B41F 31/13; B41F 31/007; B41F 33/10
See application file for complete search history.

(56) References Cited

U.S. PATENT DOCUMENTS 5,988,065 A * 11/1999 Schroder ..... F16K 31/52408 101/232
2008/0092759 A1 4/2008 Fujiwara

FOREIGN PATENT DOCUMENTS

JP 53-82512 7/1978
JP 59-057755 4/1984
JP 63-60324 U 4/1988
(Continued)

OTHER PUBLICATIONS

Machine translation of Hanajim et al. JP-H11-58672, published Mar. 2, 1999, translation obtained Aug. 21, 2017.*
(Continued)

*Primary Examiner* — Alison L Hindenlang
*Assistant Examiner* — Michael Robinson
(74) *Attorney, Agent, or Firm* — Mori & Ward, LLP

(57) ABSTRACT

A dampening water amount regulating apparatus 40 includes a plurality of air supply boxes 41 disposed in a line in an axial direction of a water transfer roller 8 and each defines one air blowing portion. The air supply box 41 includes a substantially U-shaped air passage 67 that allows air in an air supply chamber 57 to pass along an outer peripheral surface of the water transfer roller 8 and supplies the same into an air discharge chamber 60. A valve mechanism 44 that increases and decreases an air amount is provided at a midsection of the air passage 67.

4 Claims, 12 Drawing Sheets

(56) References Cited

FOREIGN PATENT DOCUMENTS

| | | |
|---|---|---|
| JP | 04-11637 U | 1/1992 |
| JP | 06-71863 | 3/1994 |
| JP | 11-58672 | 3/1999 |
| JP | 2002-240245 | 8/2002 |
| JP | 2005-262785 | 9/2005 |
| JP | 2008-105190 | 5/2008 |
| JP | 2009-056663 | 3/2009 |

OTHER PUBLICATIONS

FLS Inc., Human Translation of Tokunaga, JP S-63-060324U, published Jul. 30, 1981, translated Aug. 2017.*
International Search Report for corresponding International Application No. PCT/JP2016/064312, dated Aug. 9, 2016.
Written Opinion for corresponding International Application No. PCT/JP2016/064312, dated Aug. 9, 2016.
Extended European Search Report for corresponding EP Application No. 16751140.1-1014, dated Jan. 11, 2018.

* cited by examiner

DAMPENING APPARATUS FOR PRINTER AND PRINTER HAVING THE SAME

TECHNICAL FIELD

The present invention relates to a dampening apparatus (water supplying apparatus) for a printer and a printer and, more specifically, to a dampening apparatus for a printer configured to supply dampening water to a plate of a plate cylinder of a printing unit or the like from a water supply such as a water tank in an offset printer, and a printer having the dampening apparatus.

BACKGROUND ART

An offset printer includes a dampening apparatus used therein, and the dampening apparatus includes a water fountain roller on the water supply side and a water applying roller on a printing unit side and is configured to transfer dampening water from the water fountain roller to the water applying roller (Patent Literature 1).

There is also a known dampening apparatus for an offset printer including a divided roller unit for transferring water disposed between a water fountain roller on the water supply side and a water applying roller on the printing unit side, in which the divided roller unit for transferring water includes a plurality of water transfer rollers divided in an axial direction of both rollers described above, and the water transfer rollers are configured to be switched individually between a water transfer position where the water transfer roller comes into contact with the water fountain roller and the water applying roller and a non-water transfer position where the water transfer roller is out of contact with at least one of the water fountain roller and the water applying roller (Patent Literature 2).

There is also a known dampening apparatus for an offset printer including a plurality of air blowing portions disposed in a line along an axial direction of a water transfer roller and configured to blow air to the roller (Patent Literature 3).

CITED REFERENCE

Patent Literatures

PTL 1: JP-A-2008-105190
PTL 2: JP-A-2005-262785
PTL 3: JP-A-11-58672

DISCLOSURE OF INVENTION

The dampening apparatus for a printer disclosed in PTL 1 has a problem such that when printing on a printed matter having a width smaller than an axial length of the roller, for example, since a large amount of dampening water exists at both end portions of the roller, ink is emulsified in the vicinities of both end portions of the printed matter, so that ink may splash or may be reduced in viscosity. In the case where patterned surface areas are significantly different between a left half and a right half as well, the same problem as described above may occur on the side having less patterned surface area.

As regards the dampening apparatus for a printer disclosed in PTL 2, since an amount of dampening water is controlled in each of the water transfer rollers, favorable supply of dampening water is enabled, and the above-described problem is solved.

However, in the existing dampening apparatuses for a printer, the rollers are not divided in the axial direction. Therefore, adequate supply of dampening water is desired also for the dampening apparatuses for a printer using the rollers which are not divided in the axial direction.

Although it is preferable to control the dampening water corresponding to an ink supply amount, such control has not been performed in the related art since an ink supply apparatus and the dampening apparatus have different structures.

With the configuration as in PTL 3 having the plurality of air blowing portions disposed in a line in the axial direction of the rollers and configured to blow air to the rollers, distribution of the amount of dampening water in the axial direction may be changed even in the dampening apparatus for the printer in which a roller which is not divided in the axial direction is used. However, there is a problem that the same performance as in PTL 2 cannot be obtained only by blowing air.

It is an object of the present invention to provide a dampening apparatus for a printer, which enables adequate supply of dampening water.

It is another object of the present invention to provide a printer provided with the above-described dampening apparatus for a printer, in which dampening water is controlled corresponding to an ink supply amount.

Solution to Problem

A dampening apparatus for a printer according to the present invention is a dampening apparatus including: one or more rollers on the water supply side; a roller on a printing unit side; and a dampening water amount regulating apparatus, being configured in such a manner that dampening water is transferred from the roller on the water supply side to the roller on the printing unit side, wherein the dampening water amount regulating apparatus includes a plurality of air blowing portions disposed in a line in an axial direction of any one of the rollers on the water supply side and configured to be capable of adjusting an air blowing amount to the rollers independently by valve mechanisms, and the air blowing portions each include an air blowing passage that allows air to flow along an outer peripheral surface of the roller.

Here, the roller on the printing unit side corresponds to those coming into abutment with a plate cylinder (a roller referred to as a water applying roller), and one or more of the rollers on the water supply side correspond to a roller other than the rollers that come into abutment with the plate cylinder (one of a water fountain roller that is provided partly in a water tank and one or more water transfer rollers provided between the water applying roller and the water fountain roller).

By blowing air, the amount of dampening water adhered to a portion of the roller to which the air is blown decreases. By adjusting the air blowing amount onto the roller depending on the pattern, so that improvement in printing quality is achieved. With each of the air blowing portions having the air blowing passage that allows air to flow along the outer peripheral surface of the roller, air flows smoothly, and adjustment may be performed with high degree of accuracy.

For example, a flow rate control valve that is capable of controlling an opening-and-closing amount may be used as the valve mechanism. The valve mechanism is not limited thereto, and any valve mechanism which may translate from a state of closing the air passage entirely to a state of closing part of the air passage, and further to a state of opening the air passage (and vice versa) entirely is applicable.

The plurality of air blowing portions are preferably provided along the axial direction so as to be adjacent to each other in order to respond adequately to the patterned surface area. The air blowing portions may be disposed only at both end portions of the roller, for example, in order to respond adequately to an excessive amount of dampening water that is liable to occur especially at both end portions of the printed matter.

Each of the air blowing portions may be connected to an air introduction pipe via the flow rate control valve.

By adjustment of the opening-and-closing amount of the flow rate regulation valve, the blowing amount of air is increased or decreased, and the amount of the dampening water may be reduced by increasing the blowing amount of air, and the amount of the dampening water may be increased by decreasing the blowing amount of air. A rotary valve such as a butterfly valve and a ball valve in which a valve element rotates in a direction intersecting a direction of a flow channel is used as the flow rate regulation valve. However, the flow rate regulation valve is not limited to the rotary valve. The flow rate regulation valve is preferably an electric valve that is configured to be capable of electrically controlling a degree of opening and closing of the flow channel. The opening-and-closing amount of the flow rate regulation valve is preferably controlled based on data of the ink supply apparatus that controls the ink amount, the speed of feeding of a printed matter, and the speed of rotation of the roller. With the electric valve, such control of the flow rate regulation valves is facilitated.

Each of the air blowing portions may be connected to an air discharge pipe connected to a suction apparatus.

In this configuration, even in the case where the plurality of air blowing portions are provided so as to be adjacent to each other, airs blown out therefrom do not interfere with each other, and adjustment of the air blowing amount with high degree of accuracy is enabled.

The direction of flow of air may be the same direction as the direction of rotation of the roller. However, a direction opposite to the direction of rotation of the roller is preferable.

The dampening water amount regulating apparatus may include a plurality of air supply boxes disposed in a line in an axial direction of the roller and each defining one air blowing portion, an air supply pipe that supplies air to any one of the air supply boxes, and an air discharge pipe that sucks air from any one of the air supply boxes, in which each of the air supply boxes includes an air supply chamber that communicates with an adjacent air supply box and receives a supply of air via an air supply pipe, an air discharge chamber that communicates with an adjacent air supply box and discharges air via the air discharge pipe, and an air passage partitioned by a diaphragm from an adjacent air supply box and allows air in the air supply chamber to pass along the outer peripheral surface of the roller and to supply the air into the air discharge chamber, and in which the valve mechanism that increases and decreases the amount of air may be provided at a midsection of the air passage.

Adjacently disposed air supply chambers of the air supply boxes are communicated with each other and thus function as air introduction pipe is achieved. Therefore, the air introduction pipe may be omitted. In the same manner, adjacently disposed air discharge chambers of the air supply boxes are communicated with each other and thus function as air discharge pipe is achieved. Therefore, the air discharge pipe may be omitted. In this manner, the introduction pipe and the air discharge pipe for supplying air to each of the air blowing portions are not necessary, so that a compact dampening water amount regulating apparatus is achieved.

In the dampening water amount regulating apparatus provided with the air supply boxes, the air supply chamber in each of the air supply boxes may be provided with a partitioning wall having a communication hole formed therein, and the valve mechanism includes a plug body movable to a position for closing the communication hole entirely, a position for closing part of the communication hole and a position for opening the communication hole entirely, and a plug body drive unit that moves the plug body.

The plug body may have a disk shape that moves along a circumference that passes through the center of the communication hole, or may have a conical shape that moves along an axial line concentric with the communication hole. The plug body drive unit is, for example, a servo motor. However, the plug body drive unit is not limited to the servo motor.

The ink supply apparatus for a printer provided with the dampening apparatus described above is not limited, and may have a configuration in which a plurality of divided ink transfer rollers are provided and the amount of ink to be supplied to the ink fountain roller from the interior of the ink fountain is adjusted by adjustment of time period during which each of the ink transfer rollers is in contact with the ink fountain roller, or a configuration in which a plurality of ink fountain keys are provided and the amount of ink to be supplied to the ink fountain roller from the interior of the ink fountain is adjusted by adjustment of an opening degree of the ink fountain keys. Other known ink supply apparatuses may also be employed. In any cases, control of the ink supply amount is preferably associated with control of the amount of dampening water.

In the case where each of the ink transfer rollers is combined with the ink supply apparatus configured to adjust the amount of ink by adjustment of time period during which each of the ink transfer rollers is in contact with the ink fountain roller, by setting the number of the air blowing portions of the dampening apparatus and the number of the ink transfer rollers of the ink supply apparatus to be the same, and by using control data in the ink supply apparatus when controlling the air flow rate at the air blowing portions, control of the amount of the dampening water so as to respond to the ink supply amount is achieved, so that the printing quality is significantly improved.

The printer having such a configuration is, for example, a printer provided with an ink supply apparatus and a dampening apparatus, in which the ink supply apparatus includes a plurality of ink transfer rollers divided in a longitudinal direction of an ink fountain roller disposed in proximity to the ink fountain roller that constitutes an ink fountain, and each of the ink transfer rollers is adapted to be switched between a transfer position where the ink transfer roller comes into contact with the ink fountain roller and a non-transfer position where the ink transfer roller is out of contact with the ink fountain roller by individual switching of a switch valve between ON and OFF, and the control apparatus of the ink supply apparatus includes target value setting means that sets a target value of the ink amount and switch valve ON/OFF operation means that determines ON/OFF time of the switch valve in accordance with the target value of the ink amount set by the target value setting means, in which the dampening apparatus is the dampening apparatus according to any one of those described above, the number of the air blowing portions is the same as the number of the ink transfer rollers, and each of the air blowing portions is adapted to be adjusted in blowing amount by driving a drive unit, and in which a control apparatus of the dampening apparatus uses a target value stored in target value setting means of the control apparatus of the ink supply apparatus to control the drive unit.

According to the dampening apparatus for a printer of the present invention, the amount of the dampening water may be adjusted partly depending on the position in the direction of the width of the printed matter as described above, so that adequate supply of the dampening water is enabled. With each of the air blowing portions having the air blowing passage that allows air to flow along the outer peripheral surface of the roller, air flows smoothly, and adjustment may be performed with high degree of accuracy.

According to the printer of the present invention, the ink supply apparatus in which accuracy of adjustment of the ink supply amount is high and the above-described dampening apparatus in which accuracy of adjustment of the dampening water is high are combined and the dampening water is controlled so as to respond to the ink supply amount, whereby a significant improvement of the printing quality is enabled.

REFERENCE SIGN LIST (1): dampening apparatus, (5): water fountain roller (roller on the water supply side), (6): water applying roller (roller on the printing unit side), (8): water transfer roller (roller on the water supply side), (9): dampening water amount regulating apparatus, (10): ink supply apparatus control apparatus, (11): air blowing portion, (24*b*): air blowing passage, (25): air introduction pipe, (26): flow rate regulation valve, (28): air discharge pipe, (30): suction fan (suction apparatus), (31): control panel (control apparatus), (32): servo motor, (33) motor rotation amount operating means, (40): dampening water amount regulating apparatus, (41): air supply box, (42): air supply pipe, (43): air discharging pipe, (44): valve mechanism, (56): second partitioning wall (partitioning wall), (57): first chamber (air supply chamber), (58): second chamber (air blowing portion), (59): third chamber (air passage), (60): fourth chamber (air discharge chamber), (62): second diaphragm (diaphragm), (64): communication hole, (71): servo motor (drive unit), (74): plug body, (90): ink supply apparatus, (91): ink fountain, (92): ink fountain roller, (93): ink transfer roller, (95): switch valve, (96): target value setting means, (97): switch valve ON/OFF operation means

DESCRIPTION OF EMBODIMENTS

Figure 1:
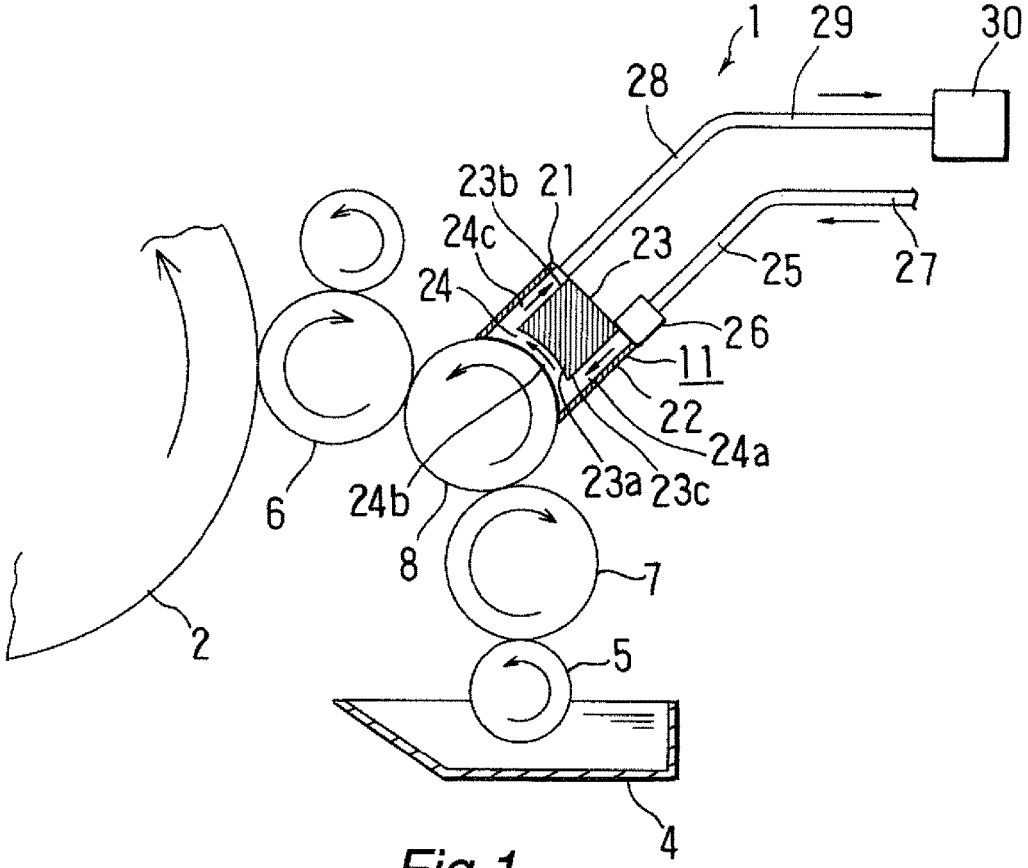
FIG. 1 is a side view of a dampening apparatus for a printer illustrating a first embodiment of the present invention.
Figure 2:
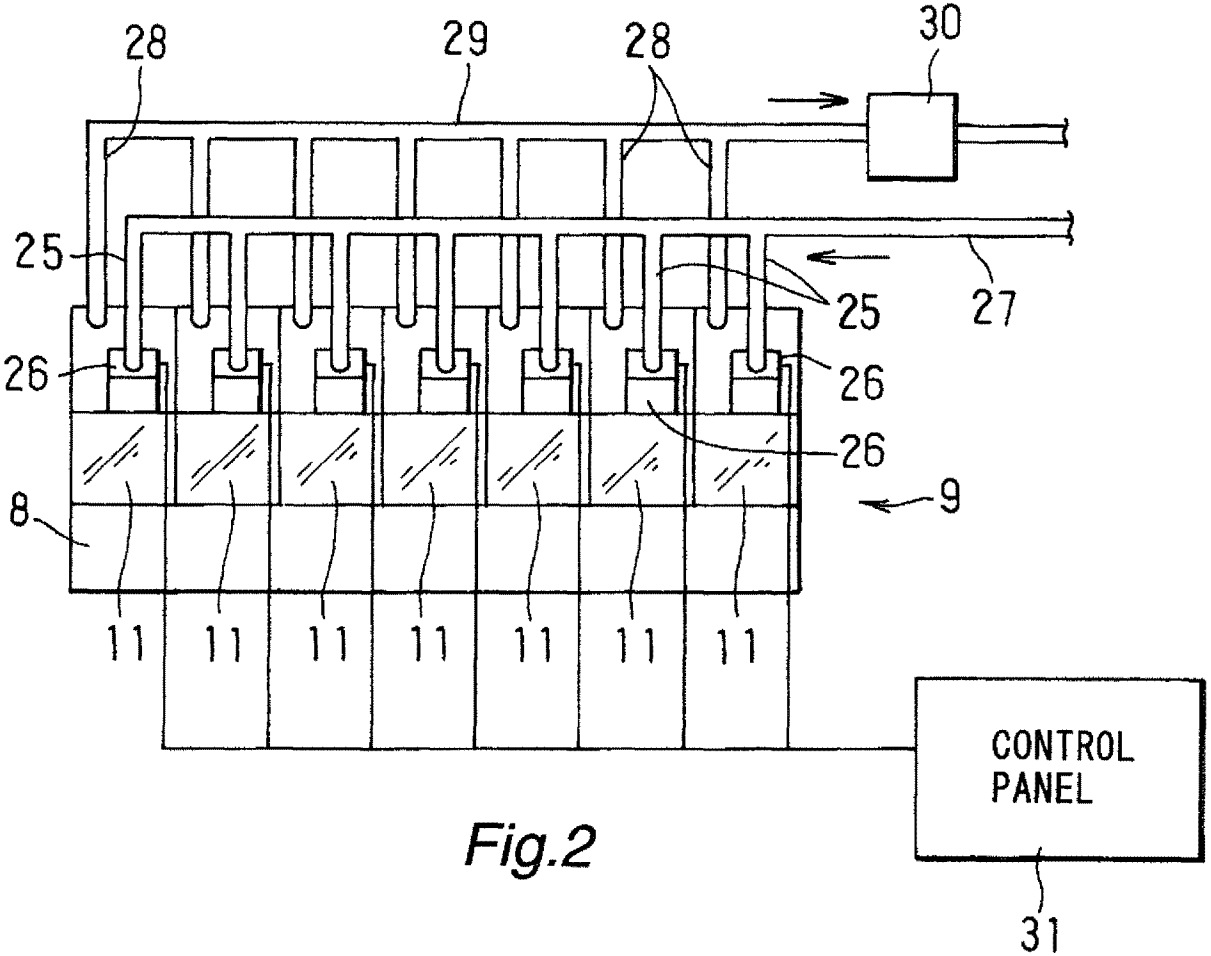
FIG. 2 is a plan view of FIG. 1.

Referring now to FIG. 1 and FIG. 2, an embodiment of the present invention will be described. In the following description, the left in FIG. 1 is referred to as front, and the right in the same is referred to as rear. The left and the right in FIG. 2 are referred to as left and right.

As illustrated in FIG. 1 and FIG. 2, a dampening water apparatus (1) for a printer includes a water tank (4) as a water supply, a water fountain roller (5) on the water tank (4) side, a water applying roller (6) on the side of a plate cylinder (2) of a printing unit, two water transfer rollers (7) (8) provided between the water fountain roller (5) and the water applying roller (6), and a dampening water amount regulating apparatus (9) provided on one of the water transfer rollers (8).

Although illustration is omitted, an ink application roller that supplies ink in contact with a plate of the plate cylinder (2) is provided, and ink in an ink fountain is transferred to the ink application roller via an ink source roller, an ink transfer roller, a plurality of ink distributing rollers, and an ink reciprocation roller, and is supplied to the plate of the plate cylinder (2). In the printing unit, the ink supplied to the plate of the plate cylinder (2) from an ink apparatus is transferred to a printed material such as printing sheet directly, or via other cylinder such as a rubber cylinder or a roller, so that a printed matter is obtained.

In association with supply of ink to the plate of the plate cylinder (2), water in the water tank (4) is supplied to the plate of the plate cylinder (2) as dampening water via the water fountain roller (5), the water transfer rollers (7) (8), and the water applying roller (6). The dampening water affect the quality of the printed matter significantly, and thus adequate supply is a challenge.

The plate cylinder (2), the water fountain roller (5), the water transfer rollers (7) (8), and the water applying roller (6) extend in a lateral direction (horizontal direction). The water applying roller (6) is disposed behind the plate cylinder (2). The water fountain roller (5) is formed of a metal, the water applying roller (6) is formed of rubber, and one of the rollers (7) out of the water transfer rollers (7) (8) is formed of a metal, and the other roller (8) is formed of rubber.

The water fountain roller (5), the water transfer rollers (7) (8), and the water applying roller (6) are rotatably supported by a frame of the printer at both left and right ends, and are rotated continuously in a direction indicated by an arrow in FIG. 1 by a drive unit, which is not illustrated, at a predetermined rotational speed synchronized with each other. The water fountain roller (5) constantly rotates in a state of being soaked at a lower portion thereof into water in the water tank (4), and the water applying roller (6) rotates constantly in a state of keeping in contact with the plate of the plate cylinder (2).

The dampening water amount regulating apparatus (9) includes a plurality of air blowing portions (11) disposed in a line in an axial direction of the water transfer roller (8), and controls distribution of dampening water in an axial direction of the water transfer roller (8) by controlling air blowing amounts from the respective air blowing portions (11) to the roller separately. Accordingly, the amounts of the dampening water in the axial direction of the water applying roller (6) are adjusted in accordance with the positions of the printed matter in the width direction.

The air blowing portion (11) includes a pair of side walls (21) (22) that come into abutment at distal ends portions thereof with an outer periphery of the water transfer roller (8), and a passage forming block (23) disposed between the pair of side walls (21) (22) to define an air passage (24) between the outer periphery of the water transfer roller (8) and the pair of side walls (21) (22).

The passage forming block (23) includes a curved opposed surface (23*a*) that opposes the outer periphery of the water transfer roller (8) at a predetermined distance and a pair of planar opposed surfaces (23*b*) (23*c*) that oppose the pair of side walls (21) (22).

A passage (24*a*) defined by one of the side walls (21) and one of the planar opposed surfaces (23*b*) are connected at one end of an air introduction pipe (25) to an opening thereof via a flow rate regulation valve (valve mechanism) (26), and defines the introduction-side passage (24*a*). The other end of the air introduction pipe (25) is coupled to an introduction-side coupling pipe (27), and the introduction-side coupling pipe (27) is connected to a high-pressure air supply source, illustration of which is omitted.

The flow rate regulation valve (26) is, for example, a rotational valve such as a ball valve, which is an electric valve capable of electrically controlling the degree of opening and closing a flow passage. However, the flow rate regulation valve (26) is not limited thereto, and any type of valve mechanisms which may translate from a state of fully closing the air passage (24) to a state of partly closing the air passage (24), and then translate to a state of fully opening the air passage (24) (and vice versa) are applicable.

The passage (24*a*) defined by the other side wall (22) and the other planar opposed surface (23*c*) is connected at the opening thereof with one end of an air discharge pipe (28) and defines a discharge-side passage (24*c*). The other end of the air discharge pipe (28) is coupled to a discharge-side coupling pipe (29), and the discharge-side coupling pipe (29) is connected to a suction fan (suction apparatus) (30) that forcedly sucks air in the discharge-side coupling pipe (29).

The introduction-side passage (24*a*) and the discharge-side passage (24*c*) are parallel to each other, and both extend in a direction orthogonal to a line parallel to the axial direction of the water transfer roller (8).

A passage (24*b*) defined by the outer periphery of the water transfer roller (8) and the curved opposed surface (23*a*) is located between the introduction-side passage (24*a*) and the discharge-side passage (24*c*), and constitutes the air blowing passage (24*b*) which allows air to flow in the same direction as the direction of rotation of the water transfer roller (8) along an outer peripheral surface of the water transfer roller (8) and has an arcuate cross section.

In this manner, the substantially U-shaped air passage (24) in which air flows from the introduction-side passage (24*a*) defined by the one of the side walls (21) and the one of the planar opposed surfaces (23*b*) into the air blowing portion (11), flows in the air blowing passage (24*b*) defined by the outer periphery of the water transfer roller (8) and the curved opposed surface (23*a*), and then flows out from the discharge-side passage (24*c*) defined by a space between the other wall surface and the other planar opposed surface is formed.

The plurality of air blowing portions (11) are provided so as to be adjacent to each other. However, since the air passage (24) is formed as described above, airs blown out from the substantially U-shaped air passage (24) do not interfere with each other.

The opening-and-closing amounts of the flow rate regulation valves (26) is controlled by the control panel (control apparatus) (31). The control apparatus (31) controls the opening-and-closing amounts of the flow rate regulation valves (26) based on data of the ink supply apparatus that controls the ink amount, a feeding speed of the printed matter, and the rotational speeds of the respective rollers (5) (6) (7) (8).

By blowing air, the amount of dampening water adhered to a portion of the water transfer roller (8) to which the air is blown decreases. Therefore, by adjusting the air blowing amount from the air blowing portion (11) to the roller in accordance with the patterned surface area, adequate supply of dampening water is enabled, and hence the printing quality is improved.

By adjustment of the opening-and-closing amount of the flow rate regulation valve (26), the blowing amount of air is increased or decreased. By increasing the blowing amount of air, the amount of the dampening water may be reduced, and by decreasing the blowing amount of air, the amount of the dampening water may be increased.

In this manner, according to the dampening water apparatus (1) for a printer described above, the amount of dampening water to be supplied to the plate of the plate cylinder (2) from the water applying roller (6) is adjusted by the air blowing portions (11) adjusted in air blowing amount individually. Therefore, the amount of dampening water in the direction of the width of the printed matter may be adjusted in accordance with the width of the printed matter and the patterned surface area. Therefore, the amount of the dampening water at an axial position of the water applying roller (6) corresponding to the direction of the width of the printed matter is adjusted in accordance with the control of the ink amount in the direction of the width of the printed matter, and thus desirable supply of dampening water in accordance with the desirable supply of ink amount is achieved. Accordingly, the amount of dampening water may be adjusted partly in accordance with the position in the direction of the width of the printed matter, and thus deterioration of quality that may specifically occur in the case where distribution of both end portions of the printed matter or of the patterned surface areas is significantly different between the left side and the right side may be prevented.

In FIG. 1, although a direction of a flow of air is illustrated to be the same as the direction of rotation of the water transfer roller (8), the direction of a flow of air is preferably a direction opposite to the direction of rotation of the water transfer roller (8). In other words, the air introduction unit composed of the air introduction pipes (25), a flow rate regulation valves (26), and the introduction-side coupling pipe (27), and an air discharge unit composed of the air discharge pipe (28), the discharge-side coupling pipe (29), and the suction fan (suction apparatus) (30) are preferably replaced.

Figure 3:
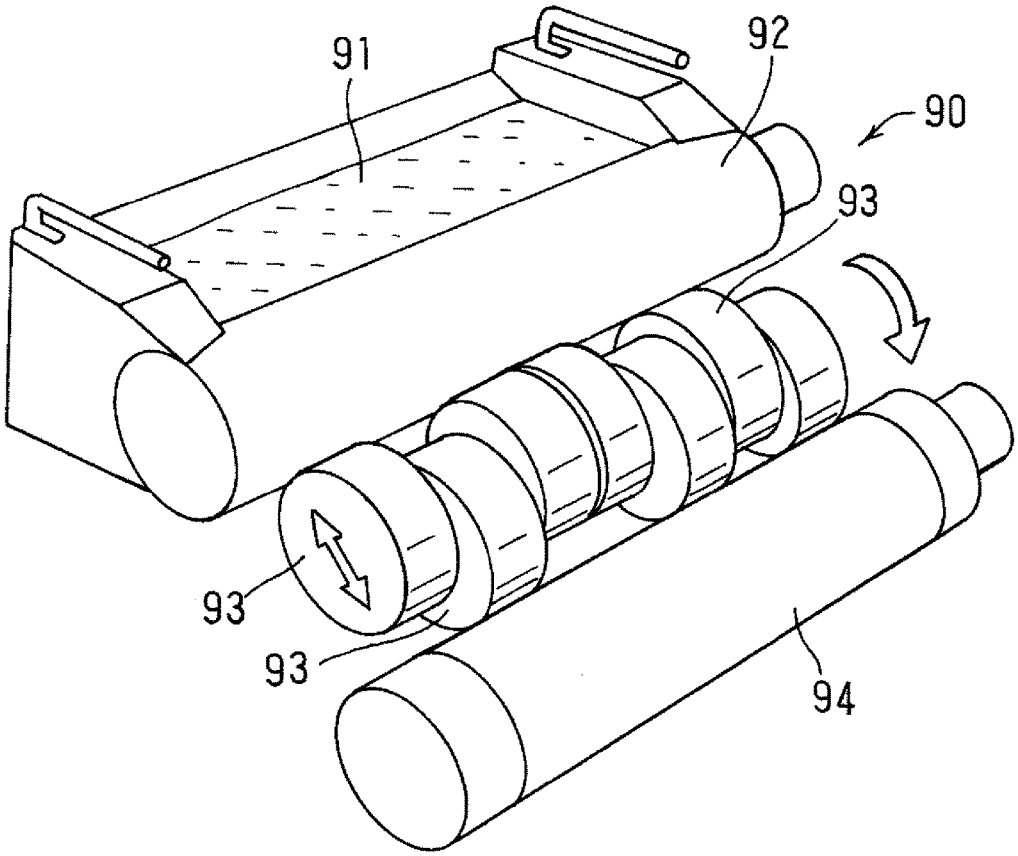
FIG. 3 is a perspective view illustrating an example of an ink supply apparatus used in the printer of the present invention.

An ink supply apparatus (90) of the printer in which the dampening water apparatus (1) is used is configured, for example, as illustrated in FIG. 3, in such a manner that a plurality of ink transfer rollers (93) divided in the direction of the length of an ink fountain roller (92) are disposed in proximity to the ink fountain roller (92) which constitutes an ink fountain (91), the ink transfer rollers (93) are configured to be switched individually between a transfer position where the ink transfer rollers (93) come into contact with the ink fountain roller (92) and a non-transfer position where the ink transfer rollers (93) are out of contact with the ink fountain roller (92) and in contact with an ink distributing roller (94), the positions of the required ink transfer rollers (93) are switched to transfer ink at every transfer timing at predetermined intervals, and the rotational angle of the ink fountain roller (92) from contact to separation of the respective ink transfer rollers (93) with respect to the ink fountain roller (92) is controlled, so that the length of the circumference of ink to be transferred from the ink fountain roller (92) to the ink transfer rollers (93) (a contact length per turn) may be controlled.

With the ink supply apparatus (90) configured in this manner, the ink amount is controlled individually for the ink transfer rollers (93) by difference of optimal ink amount depending on the position in the width direction in accordance with the pattern of the printed matter, whereby the accuracy of control of the ink amount is improved.

Figure 4:
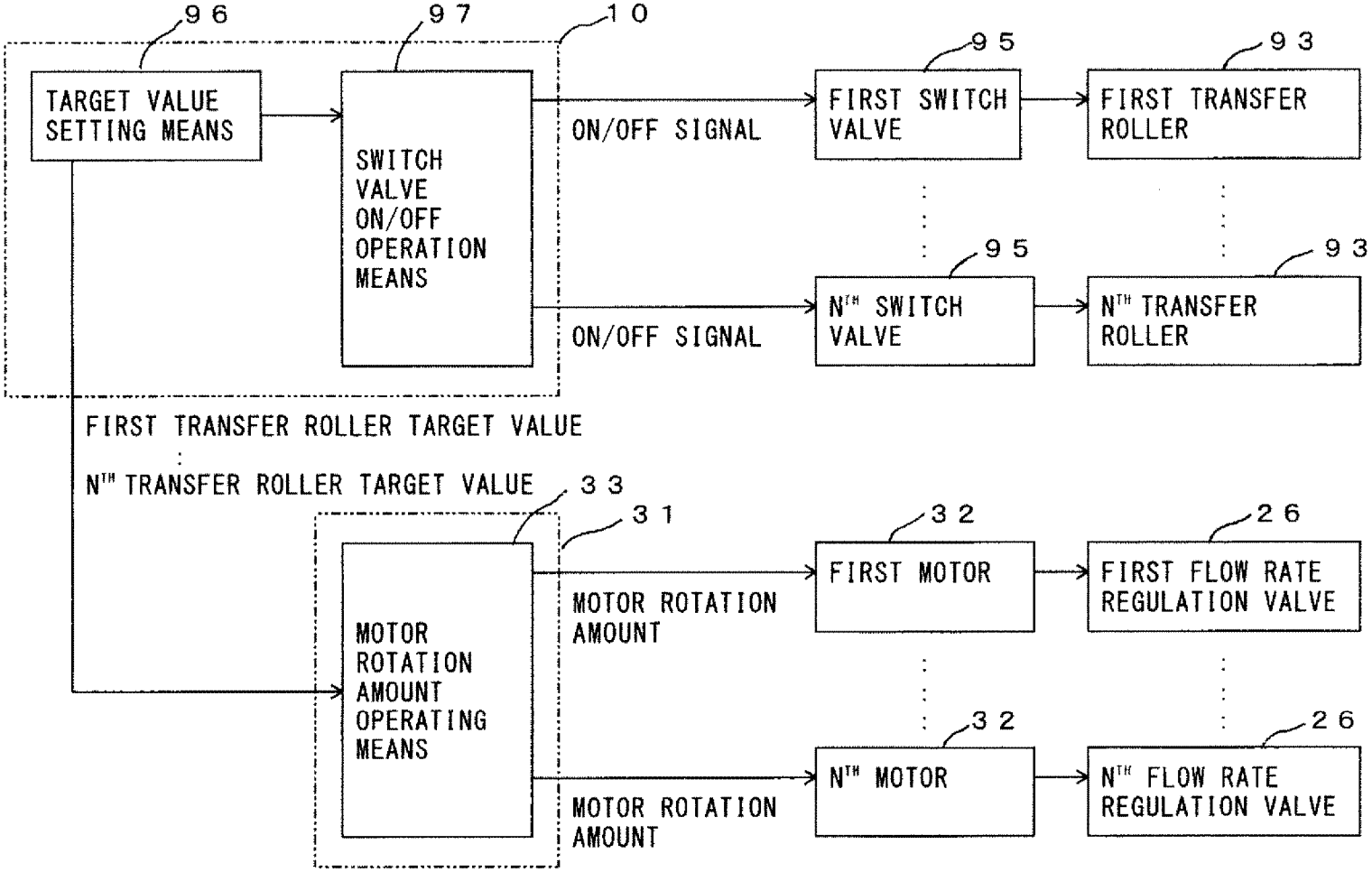
FIG. 4 is a block diagram illustrating principal portions of a control apparatus of the printer of the present invention.

FIG. 4 illustrates the control apparatus (31) of the dampening apparatus (1). The control apparatus (31) of the dampening apparatus (1) is connected with an ink supply apparatus control apparatus (10) via a relay converter, and configured to control the amount of the dampening water upon reception of ink control data (graph values and other required data) in the ink supply apparatus control apparatus (10) from the ink supply apparatus control apparatus (10).

In the ink supply apparatus (90), the control of the rotational angle of contact is performed by controlling a time period (contact command time) from output of a switching command (contact command) to a transfer position for the ink transfer rollers (93) until output of a switching command (non-contact command) to a non-transfer position as described above, so that switching of the position of the ink transfer rollers (93) is performed by ON and OFF of a switch valve (95). Consequently, the ink amount to be supplied to a printing surface is adjusted depending on the position in the direction of the width thereof.

The ink supply apparatus control apparatus (10) includes target value setting means (96) that sets a target value of the ink amount and switch valve ON/OFF operation means (97) that determines ON/OFF time of the switch valve (95) in accordance with the target value of the ink amount set by the target value setting means (96).

When the pattern to be printed is presented, the patterned surface area rate is read by using a patterned surface area reading apparatus, whereby graph values corresponding to the ink supply amount are calculated, and the graph values are converted into contact lengths between the ink transfer rollers (93) and the ink fountain roller (92) and are used for controlling the ink supply. The graph values are target values of the ink amount that indicate the amounts of ink of a predetermined color to be used by the respective ink transfer rollers (93), and are displayed by a unit of %, which are 0% when the ink of the predetermined color is not used, and 100% when used to a maximum. Therefore, the target value is set to 30%, 40%, 10%, and so forth depending on the patterned surface areas of portions corresponding to the respective ink transfer rollers (93). Based on the graph values indicated by %, the transfer time of the ink transfer rollers (93) (a contact period between the ink fountain roller (92) and the ink transfer rollers (93), that is, period when the switch valve (95) is turned ON) is controlled. If the number of colors to be used is eight, eight plate cylinders (eight units, each unit including the plurality of ink transfer rollers (93)), are used, and the graph values are set for each of the ink transfer rollers (93) for each colors (each plate cylinder=each ink transfer roller unit).

The target value setting means (96) sets the graph values (that is, the target values) for each of the ink transfer rollers (93) and each color, and based on the set target values, the target values of the contact length of the first to the Nth ink transfer rollers (93) are obtained.

The switch valve ON/OFF operation means (97) converts the target values of the contact lengths of the first to Nth transfer rollers (93) into ON/OFF time of the first to the Nth switch valves (95), and transmits ON/OFF signals required for the respective first to the $N^{th}$ switch valves (95). Accordingly, control is performed to obtain the optimal contact lengths for each of the first to the $N^{th}$ transfer rollers (93). In this manner, concentrations of the respective colors are controlled to be constant irrespective of position.

The flow rate regulation valves (26) of the dampening water apparatus (1) are adapted to be driven by, for example, servo motors (32), respectively. The control apparatus (31) of the dampening water apparatus (1) is adapted to be provided with motor rotation amount operating means (33). Here, the control apparatus (31) of the dampening water apparatus (1) is not provided with specific target value setting means, and is connected to the ink supply apparatus control apparatus (10) via a relay converter or the like to receive ink supply amount control data such as target values of the contact lengths of the first to the $N^{th}$ transfer rollers (93) or target values of the patterned surface areas used for calculation thereof from the ink supply apparatus control apparatus (10).

The motor rotation amount operating means (33) obtains amounts of rotation of the motor of the first to the $N^{th}$ servo motors (32) corresponding to opening-and-closing amounts of the first to the $N^{th}$ flow rate regulation valves (26) from the ink supply amount control data corresponding to the first to $N^{th}$ transfer rollers (93), whereby air flow rates optimal for the respective first to the $N^{th}$ flow rate regulation valves (26) are obtained.

FIG. 5 to FIG. 18 illustrate a second embodiment of the dampening apparatus for a printer of the present invention. The configuration in the second embodiment is different from the first embodiment in configuration of the dampening water amount regulating apparatus, and a dampening water amount regulating apparatus (40) will be described in the following description.

Figure 5:
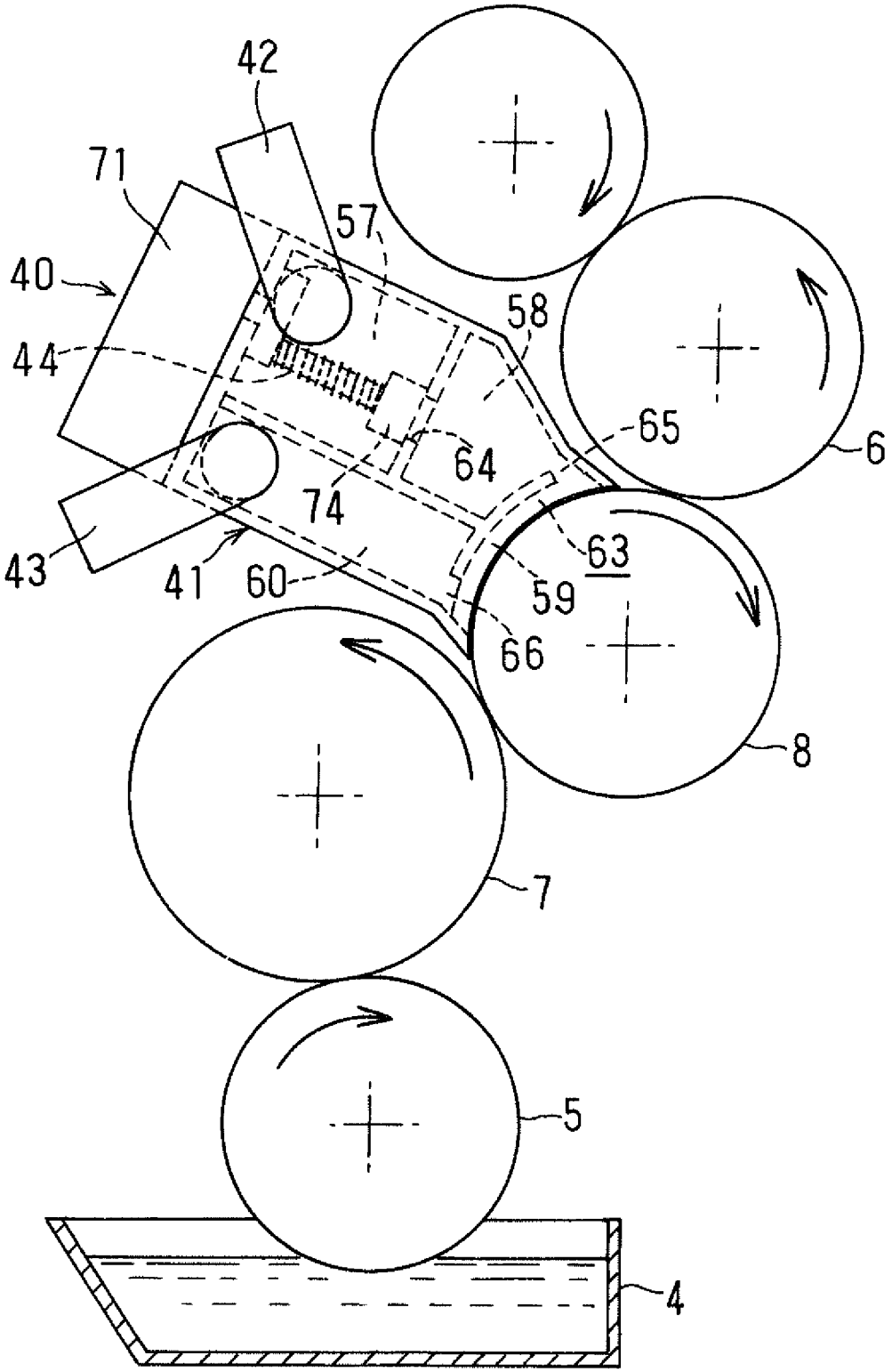
FIG. 5 is a side view of the dampening apparatus for a printer illustrating a second embodiment of the present invention.
Figure 6:
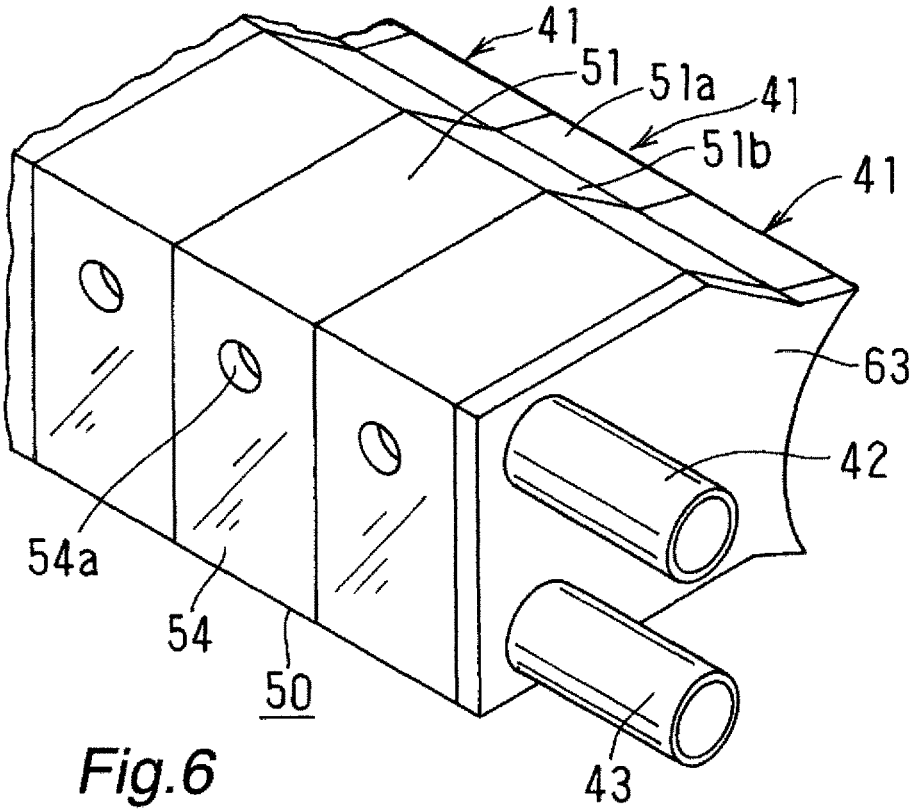
FIG. 6 is a perspective view of a plurality of air supply boxes of the dampening apparatus of the second embodiment.
Figure 7:
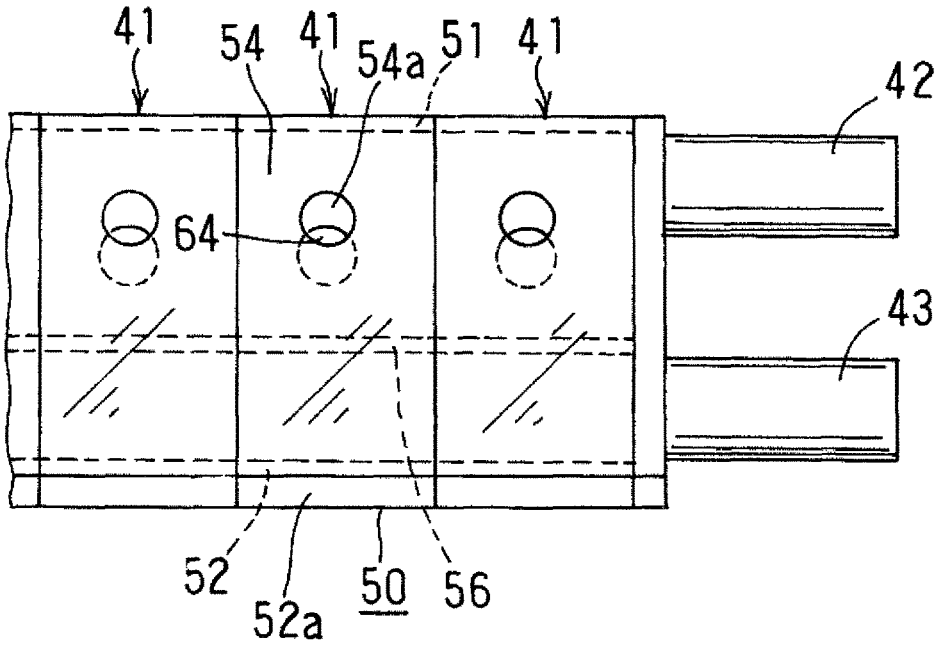
FIG. 7 is a drawing of the plurality of air supply boxes in FIG. 6 viewed from a top wall side.
Figure 8:
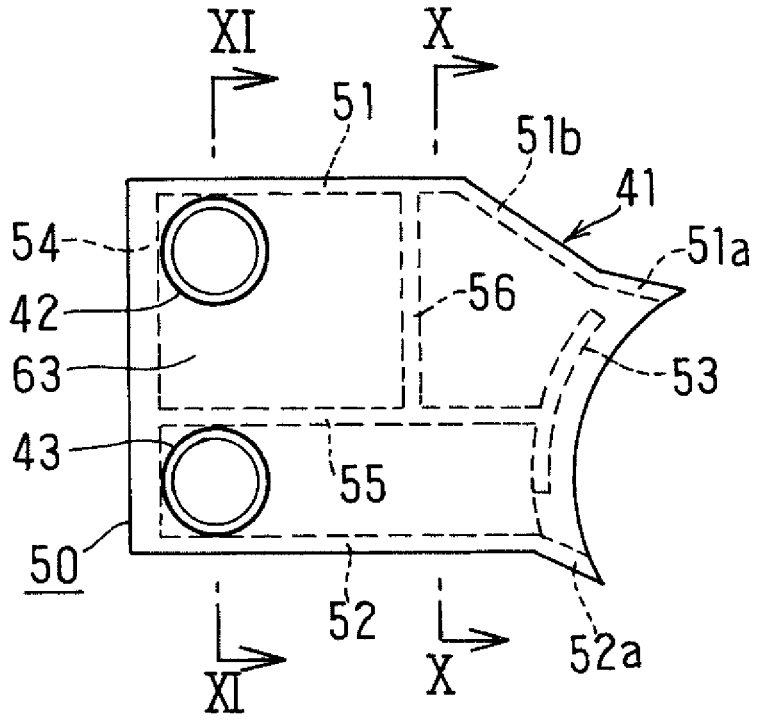
FIG. 8 is a drawing of the plurality of air supply boxes in FIG. 6 viewed from a lid side.
Figure 9:
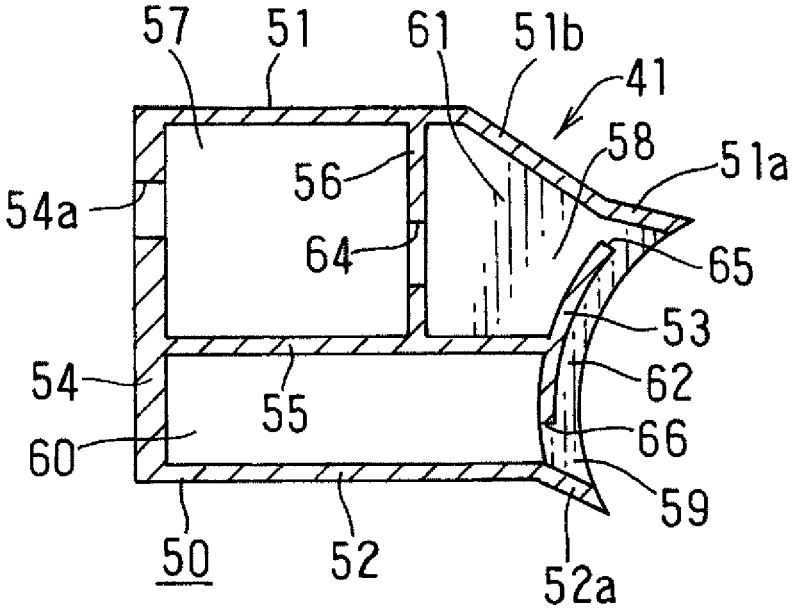
FIG. 9 is a cross-sectional view of one of the air supply boxes in FIG. 6 taken along a center plane parallel to a lid.
Figure 10:
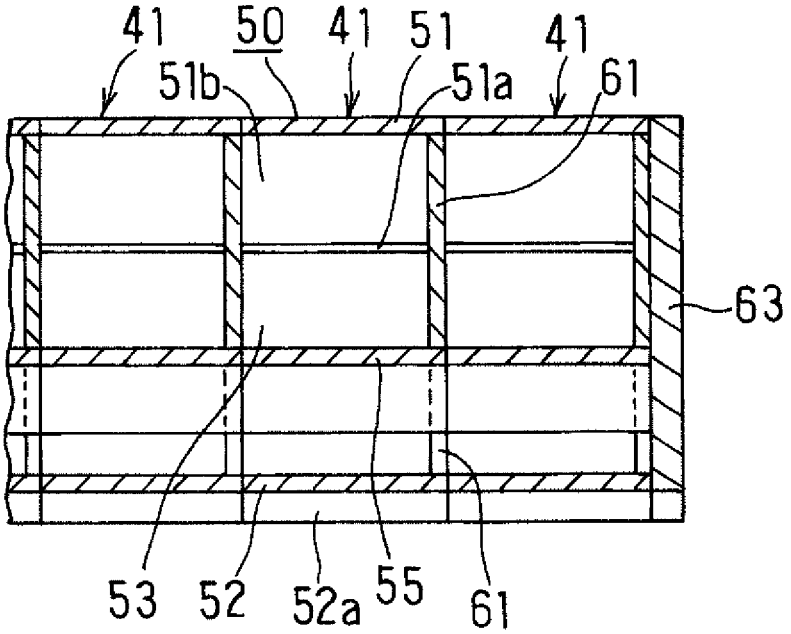
FIG. 10 is a cross-sectional view taken along the line X-X in FIG. 8.
Figure 11:
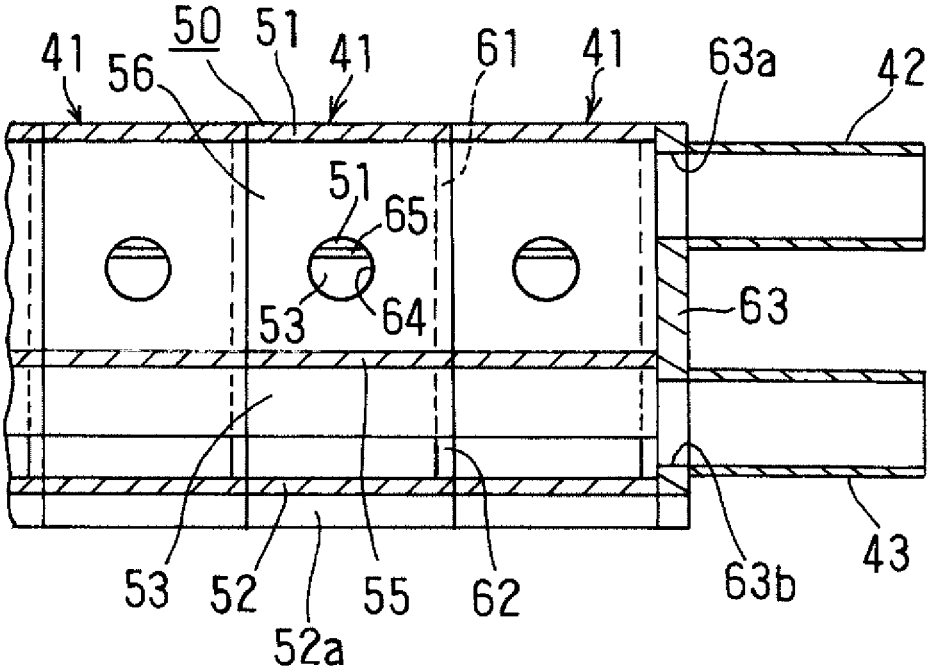
FIG. 11 is a cross-sectional view taken along the line XI-XI in FIG. 8.
Figure 12:
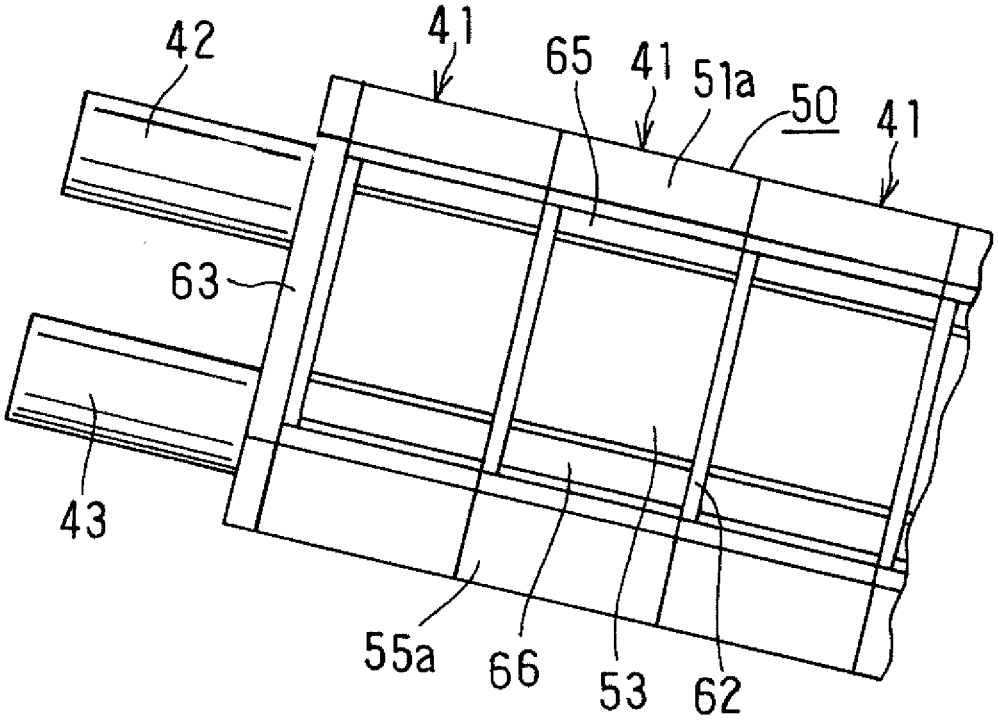
FIG. 12 is a drawing of the air supply boxes in FIG. 6 viewed from a roller side.

The dampening water amount regulating apparatus (40) of this embodiment is provided with a plurality of air supply boxes (41) disposed in a line in the lateral direction, an air supply pipe (42) that supplies air to any one of the air supply boxes (41), an air discharge pipe (43) that sucks air from any one of the air supply boxes (41), and valve mechanisms (44) provided for each of the air supply boxes (41) as illustrated in FIG. 5.

Only three of the air supply boxes (41) are illustrated for simplification of the drawing, the number of the air supply boxes (41) may be set in accordance with the object to be printed.

With the air supply boxes (41) having the shape described later, each of the air supply boxes (41) includes a substantially U-shaped air passage formed therein so as to extend from a first chamber (air supply chamber) (57) passing through a communication hole (64), and entering an second chamber (air blowing portion) (58), so that air blown out from the air outlet port (65) of the air blowing portion (58) passes through a third chamber (air blowing passage) (59) extending along the water transfer roller (8) and is discharged from an air supply port (66) communicating with a fourth chamber (air discharge chamber) (60), and an opening amount of the communication hole (64) is regulated by the valve mechanism (44).

While the direction of rotation of the water transfer roller (8) is clockwise, air is blown to dampening water on the water transfer roller (8) so that the dampening water advances in a direction opposite to the direction of rotation, that is, counterclockwise along the outer peripheral surface of the water transfer roller (8).

Each air supply box (41) has a casing (50) opened on both left and right surfaces. The casing (50) include a pair of side walls (a first side wall (51) and a second side wall (52)) each has one end portion which is exposed to the water transfer roller (8), curved bottom wall (53) which couples positions in the vicinity of the one end portion of the pair of side walls (51) (52), and a flat top wall (54) that couples the other ends of the pair of side walls (51) (52) as illustrated in FIG. 6 to FIG. 12.

A first bent portion (51*a*) close to the water transfer roller (8), and a second bent portion (51*b*) continuing to the first bent portion (51*a*) are provided at the one end portion of the first side wall (51) and only the first bent portion (52*a*) is provided at the one end portion of the second side wall (52). The first bent portions (51*a*) (52*a*) of the side walls (51) (52), respectively, are exposed to the water transfer roller (8) with a small distance to the water transfer roller (8) on the order of 0.5 mm. The bottom wall (53) is exposed to the water transfer roller (8) with a distance to the water transfer roller (8) on the order of 2 mm, which allows air to pass therethrough. The top wall (54) is provided with a motor mounting through hole (54*a*).

The casing (50) is provided with a first partitioning wall (55) that is disposed in parallel to the respective side walls (51) (52) and divides an interior of the casing (50) into a portion on the first side wall side and a portion on the second side wall side and a second partitioning wall (56) that is disposed between the first side wall (51) and the first partitioning wall (55) so as to be orthogonal thereto and partitions the portion on the first side wall side in the casing (50) into two parts, namely, a portion on the top wall side and a portion on the bottom wall side.

Accordingly, the air supply box (41) is divided into the first chamber (57) surrounded by a portion of the first side wall (51) on the top wall side, a portion of the top wall (54) on the first side wall side, a portion of the first partitioning wall (55) on the top wall side, and the second partitioning wall (56), the second chamber (58) surrounded by a portion of the first side wall (51) on the bottom wall side, the second partitioning wall (56), a portion of the first partitioning wall (55) on the bottom wall side, and a portion of the bottom wall (53) on the first side wall side, the third chamber (59) surrounded by the bottom wall (53), the first bent portion (51*a*) of the first side wall (51), and the first bent portion (52*a*) of the second side wall (52), and the fourth chamber (60) surrounded by the second side wall (52), a portion of the top wall (54) on the second side wall side, the first partitioning wall (55), and a portion of the bottom wall (53) on the second side wall side.

The fourth chamber (60) is formed into an arcuate shape extending along the outer peripheral surface of the water transfer roller (8) when viewed from the lateral direction.

A first diaphragm (61) that partitions the adjacent second chambers (58) and a second diaphragm (62) that partitions the adjacent third chambers (60) are provided at a boundary portion of the air supply box (41) adjacent to each other in the lateral direction.

A left opening of the air supply box (41) at the left end is closed by a left lid (63).

The left lid (63) is provided with a through hole (63*a*) that communicates with the first chamber (57) of the air supply box (41) at the left end, and a through hole (63*b*) that communicates with the fourth chamber (60) of the air supply box (41) at the left end. One end portion of an air supply pipe (42) is connected to an edge portion of the through hole (63*a*) that communicates with the first chamber (57), and the other end portion of the air supply pipe (42) is connected to an air source (which is not illustrated). One end portion of the air discharge pipe (43) is connected to an end portion of the through hole (63*b*) that communicates with the fourth chamber (60), and the other end portion of the air discharge pipe (43) is connected to a suction apparatus (which is not illustrated) such as a suction fan, and a vacuum pump.

The second partitioning wall (56) is provided with the communication hole (64) having a circular shape in cross section and communicating the first chamber (57) and the second chamber (58) at a center portion thereof. A portion of the bottom wall (53) on the first side wall side is provided with the air outlet port (65) having a rectangular shape in cross section for blowing air in the second chamber (58) toward the roller so as to come into contact with the first side wall (51). A portion of the bottom wall (53) on the second side wall side is provided with the air supply port (66) having a rectangular shape in cross section for supplying air blown to the roller into the fourth chamber (60) so as to come into contact with the second side wall (52).

In this manner, the interior of the air supply box (41) is provided with the substantially U-shaped air passage in which air in the first chamber (57) (that is, air supply chamber (57)) that communicates with the air supply pipe (42) passes through the communication hole (64) in the second partitioning wall (56) and flows into the second chamber (58) (that is, the air blowing portion (58)) in an dispersed manner, flows out through the air outlet port (65) (that is, the air outlet port (65)) of the second chamber (58), enters the third chamber (60) (that is, the air blowing passage (59)), passes in the third chamber (60) along the outer peripheral surface of the water transfer roller (8), and flows from the air supply port (66) into the fourth chamber (60) (that is, the air discharge chamber (60)) that communicates with the air discharge pipe (43) as illustrated in FIG. 5.

The first chambers (57) of the air supply boxes (41) communicate with each other and the fourth chambers (60) of the same communicate with each other, and air supplied through the air supply pipe (42) to the first chamber (57) of the air supply box at the left end is supplied in sequence into the first chambers (57) of the respective air supply boxes, and air in the fourth chambers (60) of the respective air supply boxes is taken out by the air discharge pipe (43) via the fourth chamber (60) of the air supply box at the left end.

The air supply box (41) may be obtained as a mold of synthetic resin provided integrally with the diaphragms (61) (62), for example, so that an air supply unit having a number of air supply boxes (41) integrally formed with each other and closed at both ends may be obtained by coupling the air supply boxes (41) with each other by adhesion or welding and the like and fixing the lids (63) at both ends by adhesion or welding.

Referring now to FIG. 13 to FIG. 17, the valve mechanism (44) disposed in each of the air supply boxes (41) will be described. In the description of the valve mechanism (44) given below, the top wall side of the casing (50) of the air supply box (41) is referred to as upper and the bottom wall side thereof is referred to as lower for the sake of convenience.

Figure 13:
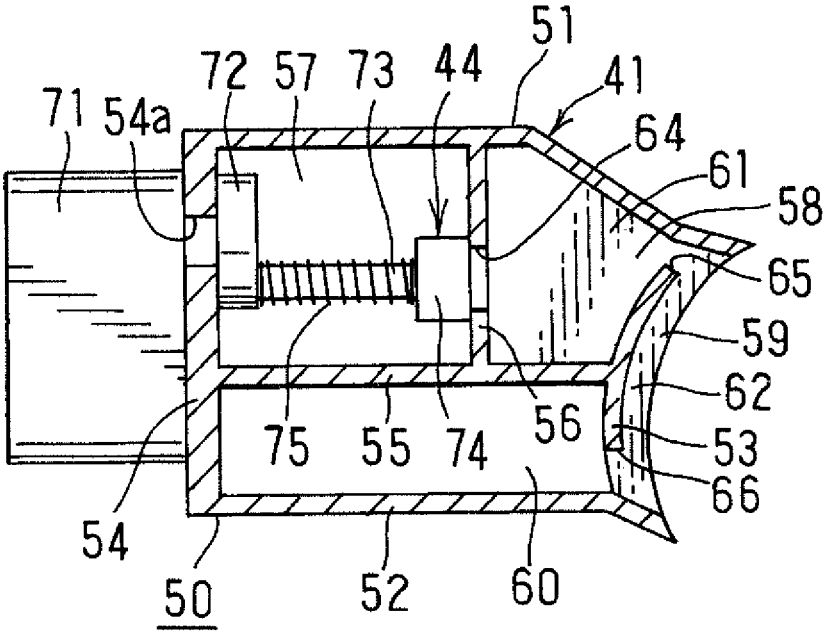
FIG. 13 is aside view illustrating a state in which a valve mechanism of the dampening apparatus of the second embodiment is built in the air supply box illustrated in FIG. 9.
Figure 14:
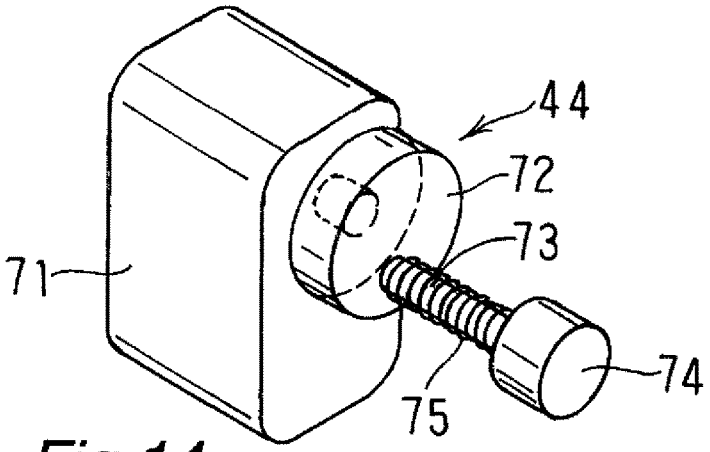
FIG. 14 is a perspective view illustrating the valve mechanism.

The valve mechanism (44) is configured to increase and decrease the amount of air passing through the communication hole (64) by increasing and decreasing the opening amount of the communication hole (64) of the second partitioning wall (56) and includes, as illustrated in FIG. 13 and FIG. 14, a servo motor (71) attached to the top wall (54) of the casing (50) having the through hole (54*a*) formed therethrough, a circular-shaped rotating panel (72) rotatably attached to a lower surface of the top wall (54) of the casing (50) and rotated by the servo motor (71), an eccentric shaft (73) fixed to an outer peripheral edge portion of the rotating panel (72) and extending downward, a plug body (74) fitted to a lower end portion of the eccentric shaft (73) and a compression coil spring (75) fitted to the eccentric shaft (73) and biasing the plug body (74) downward.

The plug body (74) has a cylindrical shape, and is provided with a cylindrical depression in which the lower end portion of the eccentric shaft (73) is fitted. A horizontal section of the plug body (74) is a circle having a diameter larger than a diameter of the communication hole (64). The compression coil spring (75) is received at an upper surface thereof by a lower surface of the rotating panel (72), and is received at a lower surface by an upper surface of the plug body (74).

Figure 15:
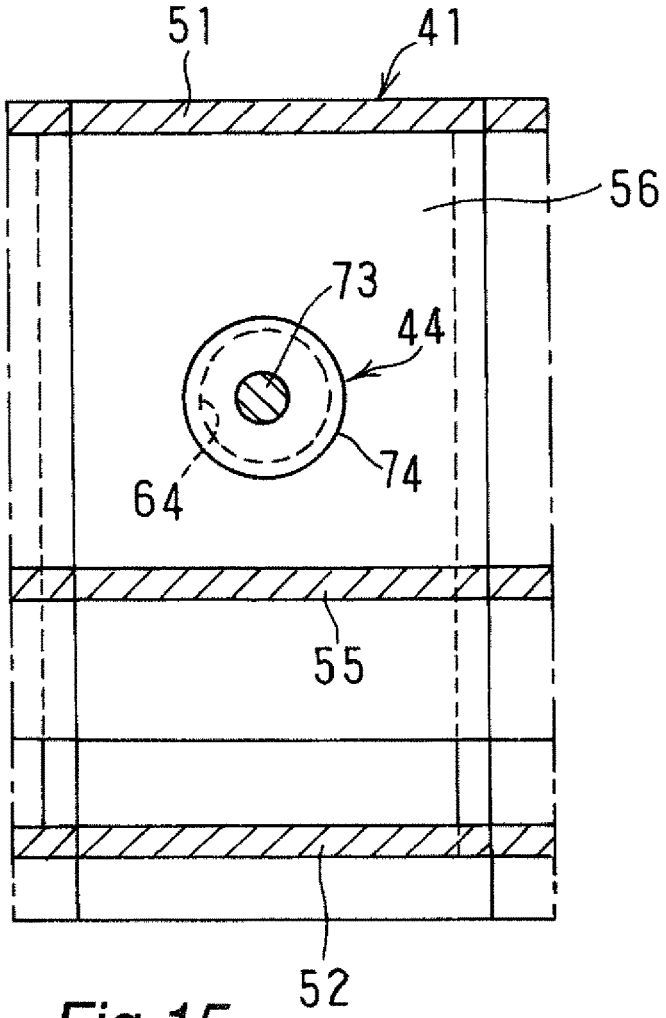
FIG. 15 is a schematic drawing illustrating a state in which an air passage of the valve mechanism is closed.
Figure 16:
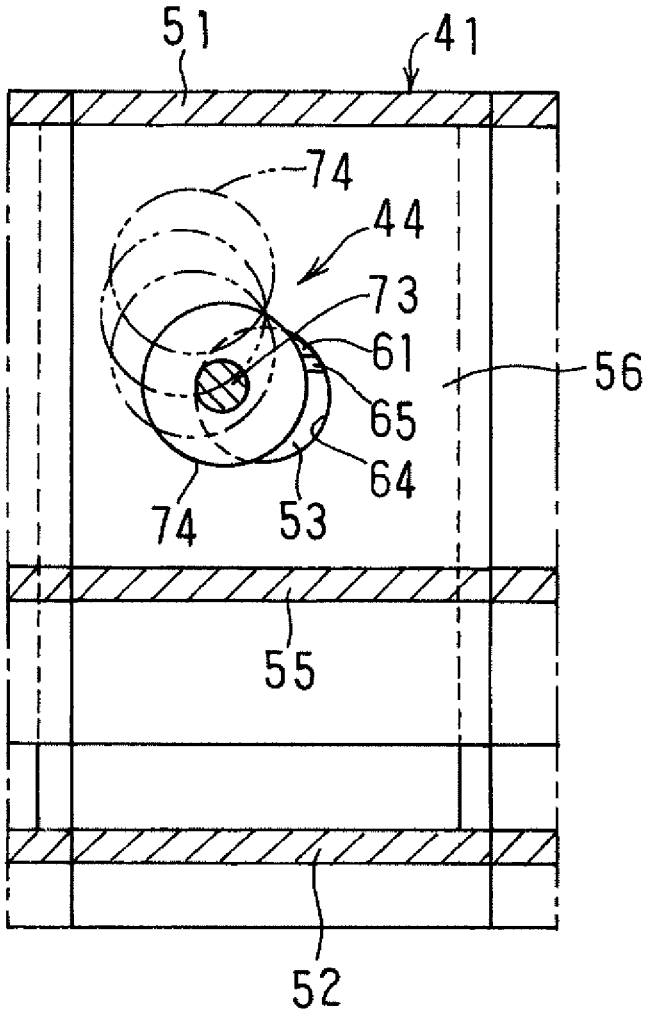
FIG. 16 is a schematic drawing illustrating variations of a state in which the air passage of the valve mechanism is opened.

FIG. 15 illustrates an air passage closed state, that is, a state in which the plug body (74) of the valve mechanism (44) closes the communication hole (64). When the rotating panel (72) is rotated by the servo motor (71) and from this state, an axial center of the eccentric shaft (73) moves along a circumference about a center axis (O) of the rotating panel (72) in association with the rotation of the rotating panel (72) as illustrated in FIG. 16. The circumference passes through a centerline of the communication hole (64).

Therefore, when the axial center of the eccentric shaft (73) is aligned with the centerline of the communication hole (64) as illustrated in FIG. 15, the communication hole (64) is completely closed by the plug body (74), and in this case, air is not blown onto the dampening water, and thus the amount of the dampening water becomes maximum.

Figure 17:
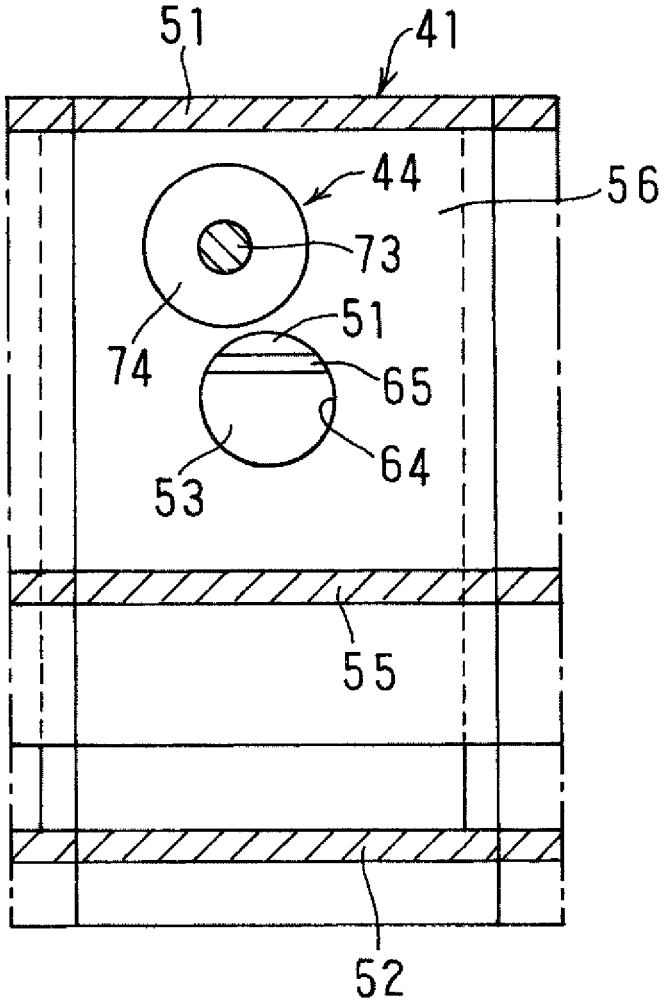
FIG. 17 is a schematic drawing illustrating a state in which the air passage of the valve mechanism is fully opened.

Then, as illustrated in FIG. 17, when the rotating panel (72) rotates from the position illustrated in FIG. 15 by 150 degrees, the plug body is completely separated from the communication hole (64). In this case, the amount of air blown onto the dampening water becomes maximum, and thus the amount of the dampening water becomes minimum.

In this manner, air is blown onto the dampening water in a direction opposite to the direction of rotation of the water transfer roller (8), and the opening amount of the communication hole (64) is increased and decreased by the valve mechanism (44), so that the amount of the dampening water may be adjusted for each segment of the water transfer roller (8) having a width corresponding to the width of the air supply box (44). Since the air blowing passage (59) for allowing air to flow along the outer peripheral surface of the water transfer roller (8) is defined by the curved bottom walls (53) of the respective air supply boxes (41), air flows smoothly, and adjustment is achieved with high degree of accuracy.

The dampening water amount regulating apparatuses (9) (40) in the description given above are provided on the water transfer roller (8), but may be provided on the water fountain roller (5) instead.

INDUSTRIAL APPLICABILITY

According to the present invention, since adequate supply of the dampening water is enabled in the dampening apparatus for a printer, the invention contributes to improvement of the printing performance.

The invention claimed is:

1. A dampening apparatus for a printer comprising:

one or more rollers on a water supply side;

a roller on a printing unit side; and a dampening water amount regulating apparatus, and being configured in such a manner that dampening water is transferred from the roller on the water supply side to the roller on the printing unit side, wherein the dampening water amount regulating apparatus includes a plurality of air supply boxes disposed in a line in an axial direction of any one of the rollers on the water supply side, an air supply pipe that supplies air to any one of the air supply boxes, an air discharge pipe that sucks air from any one of the air supply boxes, and valve mechanisms that increase and decrease an amount of the air for each of the air supply boxes, wherein each of the air supply boxes includes an air supply chamber that receives a supply of air, an air discharge chamber that discharges air, an air blowing portion that communicates with the air supply chamber and blows the air to the roller, and an air blowing passage that communicates with the air discharge chamber and allows the air blown from the air blowing portion to pass along an outer peripheral surface of the roller, and wherein each of the air supply chambers and each of the air discharge chambers communicates with that of an adjacent air supply box, and each of the air blowing portions and each of the air blowing passages are partitioned by a partition from that of an adjacent air supply box.

2. The dampening apparatus for a printer according to claim 1, wherein the air supply chamber in each of the air supply boxes is provided with a partitioning wall having a communication hole formed therein, and the valve mechanism includes a plug body movable to a position for closing the communication hole entirely, a position for closing part of the communication hole and a position opening the communication hole entirely, and a plug body drive unit that moves the plug body.

3. A printer provided with an ink supply apparatus and a dampening apparatus, wherein the ink supply apparatus includes a plurality of ink transfer rollers divided in a longitudinal direction of an ink fountain roller disposed in proximity to the ink fountain roller that constitutes an ink fountain, and each of the ink transfer rollers is adapted to be switched between a transfer position where the ink transfer roller comes into contact with the ink fountain roller and a non-transfer position where the ink transfer roller is out of contact with the ink fountain roller by individual switching of a switch valve between ON and OFF, the control apparatus of the ink supply apparatus includes target value setting means that sets a target value of the ink amount and switch valve ON/OFF operation means that determines ON/OFF time of the switch valve in accordance with the target value of the ink amount set by the target value setting means, wherein the dampening apparatus is the dampening apparatus according to claim 1, the number of the air blowing portions is the same as the number of the ink transfer rollers, and each of the air blowing portions is adapted to be adjusted in blowing amount by driving a drive unit, and wherein a control apparatus of the dampening apparatus uses a target value stored in the target value setting means of the control apparatus of the ink supply apparatus to control the drive unit.

4. The dampening apparatus for a printer according to claim 1, wherein each air supply box has a casing that includes a first side wall and a second side wall each having one end portion that is exposed to the roller, a curved bottom wall that couples positions in a vicinity of the one end portion of the respective first and second side walls, and a top wall that couples the other ends of the respective first and second side walls, the casing is provided with a first partitioning wall that is disposed in parallel to the respective first and second side walls and divides an interior of the casing into a portion on the first side wall side and a portion on the second side wall side, and a second partitioning wall that is disposed between the first side wall and the first partitioning wall so as to be orthogonal thereto and partitions the portion on the first side wall side in the casing into a portion on the top wall side and a portion on the bottom wall side, accordingly, the air supply box is divided into a first chamber defining the air supply chamber surrounded by a portion of the first side wall on the top wall side, a portion of the top wall on the first side wall side, a portion of the first partitioning wall on the top wall side, and the second partitioning wall, a second chamber defining the air blowing portion surrounded by a portion of the first side wall on the bottom wall side, the second partitioning wall, a portion of the first partitioning wall on the bottom wall side, and a portion of the bottom wall on the first side wall side, a third chamber defining the air blowing passage surrounded by the bottom wall, the one end portion of the first side wall, and the one end portion of the second side wall, and a fourth chamber defining the air discharge chamber surrounded by the second side wall, a portion of the top wall on the second side wall side, the first partitioning wall, and a portion of the bottom wall on the second side wall side.

* * * * *